US007984568B2

(12) United States Patent
Dittmer et al.

(10) Patent No.: US 7,984,568 B2
(45) Date of Patent: Jul. 26, 2011

(54) CONDENSATION TYPE LAUNDRY DRYER

(75) Inventors: Lothar Dittmer, Berlin (DE); Holger Löffler, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 584 days.

(21) Appl. No.: 11/920,014

(22) PCT Filed: Dec. 1, 2006

(86) PCT No.: PCT/EP2006/050576
§ 371 (c)(1),
(2), (4) Date: Nov. 6, 2007

(87) PCT Pub. No.: WO2006/125682
PCT Pub. Date: Nov. 30, 2006

(65) Prior Publication Data

US 2009/0126218 A1 May 21, 2009

(30) Foreign Application Priority Data

May 23, 2005 (DE) ..... 10 2005 013 053

(51) Int. Cl.
*F26B 11/02* (2006.01)

(52) U.S. Cl. ..... 34/595; 34/601; 34/602; 34/603; 34/606; 34/610; 8/142; 8/94.15; 165/186; 705/14; 219/757; 510/327; 510/421; 68/20; 68/3 R

(58) Field of Classification Search ..... 34/595, 34/901, 602, 603, 606, 610; 165/186; 8/142, 8/94.15; 705/14; 510/327, 421; 219/757
See application file for complete search history.

(56) References Cited

U.S. PATENT DOCUMENTS 2,534,269 A * 12/1950 Edwin et al. ..... 74/572.4
2,538,952 A * 1/1951 Yates et al. ..... 431/24
2,742,708 A * 4/1956 Mccormick ..... 34/76
2,752,694 A * 7/1956 Mccormick ..... 34/60
2,817,157 A * 12/1957 Mccormick ..... 34/82
3,284,369 A * 11/1966 Bergna et al. ..... 502/240
3,330,686 A * 7/1967 Rose ..... 427/302

(Continued)

FOREIGN PATENT DOCUMENTS

DE 3148573 A1 * 6/1983

(Continued)

OTHER PUBLICATIONS

International Search Report PCT/EP2006/050576.

*Primary Examiner* — Stephen M. Gravini
(74) *Attorney, Agent, or Firm* — James E. Howard; Andre Pallapies

(57) ABSTRACT

A condensation washer-dryer, in particular, the air-guiding process. The base module is used to receive function parts and components of the air guide and is closed on the rear side by means of a process air cover and forms a plastic, stable support structure for the washer-dryer. The connecting surfaces are large and extend, preferably, over the entire width of the washer-dryer. Due to said embodiment, air guiding channels are formed in a simple manner on the rear side of the base module and the housing of the process air ventilator is closed on the rear side. Sealing elements are no longer required due to said welding of said type of connection and an exceptionally high mechanical rigidity is obtained.

21 Claims, 2 Drawing Sheets

U.S. PATENT DOCUMENTS

| | | | | | |
|---|---|---|---|---|---|
| 3,420,696 | A * | 1/1969 | Cotton et al. | 8/187 |
| 3,739,487 | A * | 6/1973 | Clark | 34/77 |
| 3,805,404 | A * | 4/1974 | Gould | 34/75 |
| 3,822,145 | A * | 7/1974 | Liebowitz et al. | 427/378 |
| 3,831,292 | A * | 8/1974 | DePas | 34/75 |
| 3,859,004 | A * | 1/1975 | Condit | 34/75 |
| 3,875,679 | A * | 4/1975 | Condit | 34/75 |
| 4,055,971 | A * | 11/1977 | Hermes | 68/9 |
| 4,103,433 | A * | 8/1978 | Taylor | 34/86 |
| 4,121,009 | A * | 10/1978 | Chakrabarti | 510/520 |
| 4,203,851 | A * | 5/1980 | Ramachandran | 510/101 |
| 4,204,339 | A * | 5/1980 | Muller | 34/75 |
| 4,255,273 | A * | 3/1981 | Sakkab | 8/103 |
| 4,268,247 | A * | 5/1981 | Freze | 432/21 |
| 4,415,489 | A * | 11/1983 | Kiczek et al. | 510/532 |
| 4,427,567 | A * | 1/1984 | Benz | 510/441 |
| 4,448,699 | A * | 5/1984 | Barrat et al. | 510/513 |
| 4,536,583 | A * | 8/1985 | Mookherjee et al. | 549/1 |
| 4,584,128 | A * | 4/1986 | Mookherjee et al. | 512/7 |
| 4,620,945 | A * | 11/1986 | Mookherjee et al. | 426/535 |
| 4,621,438 | A * | 11/1986 | Lanciaux | 34/77 |
| 4,682,982 | A * | 7/1987 | Steltenkamp et al. | 510/333 |
| 4,711,730 | A * | 12/1987 | Gosselink et al. | 510/299 |
| 4,764,289 | A * | 8/1988 | Trinh | 510/517 |
| 4,785,060 | A * | 11/1988 | Nagler | 525/444 |
| 4,818,421 | A * | 4/1989 | Boris et al. | 510/297 |
| 4,818,422 | A * | 4/1989 | Adams et al. | 510/297 |
| 4,818,569 | A * | 4/1989 | Trinh et al. | 510/517 |
| 4,840,738 | A * | 6/1989 | Hardy et al. | 510/524 |
| 4,861,502 | A * | 8/1989 | Caswell | 510/299 |
| 4,863,619 | A * | 9/1989 | Borcher et al. | 510/517 |
| 4,913,828 | A * | 4/1990 | Caswell et al. | 510/297 |
| 4,915,854 | A * | 4/1990 | Mao et al. | 510/296 |
| 4,925,577 | A * | 5/1990 | Borcher et al. | 510/517 |
| 4,936,920 | A * | 6/1990 | Keritsis et al. | 131/77 |
| 4,938,879 | A * | 7/1990 | Kellett | 510/519 |
| 4,999,128 | A * | 3/1991 | Sonenstein | 510/299 |
| 5,019,280 | A * | 5/1991 | Caswell et al. | 510/328 |
| 5,041,230 | A * | 8/1991 | Borcher et al. | 510/517 |
| 5,062,973 | A * | 11/1991 | Kellett | 510/519 |
| 5,066,413 | A * | 11/1991 | Kellett | 510/519 |
| 5,094,761 | A * | 3/1992 | Trinh et al. | 510/515 |
| 5,102,564 | A * | 4/1992 | Gardlik et al. | 427/394 |
| 5,173,200 | A * | 12/1992 | Kellett | 510/519 |
| 5,234,610 | A * | 8/1993 | Gardlik et al. | 510/327 |
| 5,238,587 | A * | 8/1993 | Smith et al. | 510/277 |
| 5,276,175 | A * | 1/1994 | Dams et al. | 560/27 |
| 5,453,540 | A * | 9/1995 | Dams et al. | 564/96 |
| 5,470,492 | A * | 11/1995 | Childs et al. | 510/520 |
| 5,658,651 | A * | 8/1997 | Smith et al. | 442/59 |
| 5,689,848 | A * | 11/1997 | Saal et al. | 8/159 |
| 5,746,776 | A * | 5/1998 | Smith et al. | 8/142 |
| 5,865,851 | A * | 2/1999 | Sidoti et al. | 8/142 |
| 5,869,410 | A * | 2/1999 | Smith et al. | 442/333 |
| 5,883,069 | A * | 3/1999 | Childs et al. | 510/520 |
| 5,927,969 | A * | 7/1999 | Dover et al. | 432/103 |
| 5,929,026 | A * | 7/1999 | Childs et al. | 510/520 |
| 5,942,484 | A * | 8/1999 | Roetker et al. | 510/426 |
| 5,972,041 | A * | 10/1999 | Smith et al. | 8/142 |
| 5,997,586 | A * | 12/1999 | Smith et al. | 8/142 |
| 6,004,922 | A * | 12/1999 | Watson et al. | 510/476 |
| 6,036,727 | A * | 3/2000 | Smith | 8/142 |
| 6,086,634 | A * | 7/2000 | Smith | 8/142 |
| 6,132,474 | A * | 10/2000 | Smith et al. | 8/142 |
| 6,143,713 | A * | 11/2000 | Littig et al. | 510/520 |
| 6,179,880 | B1 * | 1/2001 | Smith | 8/142 |
| 6,238,736 | B1 * | 5/2001 | Smith et al. | 427/242 |
| 6,243,969 | B1 * | 6/2001 | Yeazell | 34/340 |
| 6,254,932 | B1 * | 7/2001 | Smith et al. | 427/242 |
| 6,395,701 | B1 * | 5/2002 | Connor et al. | 510/437 |
| 6,402,799 | B1 * | 6/2002 | Kokubo et al. | 55/396 |
| 6,491,840 | B1 * | 12/2002 | Frankenbach et al. | 252/8.91 |
| 6,602,845 | B2 * | 8/2003 | Connor et al. | 510/437 |
| 6,652,766 | B1 * | 11/2003 | Frankenbach et al. | 252/8.91 |
| 6,691,536 | B2 * | 2/2004 | Severns et al. | 68/12.27 |
| 6,748,772 | B2 * | 6/2004 | Lee et al. | 68/18 C |
| 6,769,196 | B2 * | 8/2004 | Park et al. | 34/77 |
| 6,784,997 | B2 * | 8/2004 | Lorenz et al. | 356/429 |
| 6,818,293 | B1 * | 11/2004 | Keep et al. | 428/359 |
| 6,840,069 | B2 * | 1/2005 | France et al. | 68/12.02 |
| 6,887,524 | B2 * | 5/2005 | Aouad et al. | 427/359 |
| 6,890,894 | B2 * | 5/2005 | Connor et al. | 510/501 |
| 6,898,951 | B2 * | 5/2005 | Severns et al. | 68/5 C |
| 6,916,777 | B2 * | 7/2005 | Connor et al. | 510/500 |
| 6,949,502 | B2 * | 9/2005 | Trinh et al. | 510/504 |
| 6,957,501 | B2 * | 10/2005 | Park et al. | 34/446 |
| 6,992,057 | B2 * | 1/2006 | Connor et al. | 510/515 |
| 7,010,363 | B2 * | 3/2006 | Donnelly et al. | 700/19 |
| 7,020,982 | B2 * | 4/2006 | Park et al. | 34/496 |
| 7,022,659 | B2 * | 4/2006 | Duquet et al. | 510/439 |
| 7,036,243 | B2 * | 5/2006 | Doh et al. | 34/595 |
| 7,065,904 | B2 * | 6/2006 | Lee et al. | 34/601 |
| 7,093,378 | B2 * | 8/2006 | Jeong et al. | 34/601 |
| 7,119,060 | B2 * | 10/2006 | Shefer et al. | 510/519 |
| 7,191,546 | B2 * | 3/2007 | Maruca | 34/201 |
| 7,197,838 | B2 * | 4/2007 | Jo | 34/76 |
| 7,220,365 | B2 * | 5/2007 | Qu et al. | 252/70 |
| 7,275,400 | B2 * | 10/2007 | Severns et al. | 68/18 F |
| 7,300,593 | B2 * | 11/2007 | Arredondo et al. | 210/767 |
| 7,377,052 | B2 * | 5/2008 | Maruca | 34/201 |
| 7,524,804 | B2 * | 4/2009 | Kaneda et al. | 510/311 |
| 7,526,879 | B2 * | 5/2009 | Bae et al. | 34/596 |
| 7,644,514 | B2 * | 1/2010 | Heyder et al. | 34/595 |
| 7,665,227 | B2 * | 2/2010 | Wright et al. | 34/339 |
| 7,735,345 | B2 * | 6/2010 | Wright et al. | 68/13 R |
| 7,748,139 | B2 * | 7/2010 | Hong et al. | 34/601 |
| 7,805,856 | B2 * | 10/2010 | Ga.beta.mann et al. | 34/85 |
| 7,807,616 | B2 * | 10/2010 | Meine et al. | 512/1 |
| 2001/0009699 | A1 * | 7/2001 | Smith et al. | 427/434.5 |
| 2001/0022007 | A1 * | 9/2001 | Yeazell | 8/142 |
| 2002/0004995 | A1 * | 1/2002 | France et al. | 34/524 |
| 2002/0133886 | A1 * | 9/2002 | Severns et al. | 8/142 |
| 2003/0019253 | A1 * | 1/2003 | Lorenz et al. | 68/13 R |
| 2003/0046769 | A1 * | 3/2003 | Radomyselski et al. | 8/94.15 |
| 2003/0050208 | A1 * | 3/2003 | Duquet et al. | 510/296 |
| 2003/0056393 | A1 * | 3/2003 | Lee et al. | 34/595 |
| 2003/0066638 | A1 * | 4/2003 | Qu et al. | 165/186 |
| 2003/0100469 | A1 * | 5/2003 | Connor et al. | 510/421 |
| 2003/0118730 | A1 * | 6/2003 | Aouad et al. | 427/294 |
| 2003/0209686 | A1 * | 11/2003 | Frankenbach et al. | 252/8.91 |
| 2003/0236180 | A1 * | 12/2003 | Connor et al. | 510/488 |
| 2004/0035019 | A1 * | 2/2004 | Park et al. | 34/73 |
| 2004/0068889 | A1 * | 4/2004 | Park et al. | 34/446 |
| 2004/0087461 | A1 * | 5/2004 | Connor et al. | 510/327 |
| 2004/0092418 | A1 * | 5/2004 | Connor et al. | 510/327 |
| 2004/0092419 | A1 * | 5/2004 | Connor et al. | 510/327 |
| 2004/0097392 | A1 * | 5/2004 | Connor et al. | 510/327 |
| 2004/0098878 | A1 * | 5/2004 | Park et al. | 34/595 |
| 2004/0129032 | A1 * | 7/2004 | Severns et al. | 68/5 C |
| 2004/0214984 | A1 * | 10/2004 | Keep et al. | 528/359 |
| 2004/0254654 | A1 * | 12/2004 | Donnelly et al. | 700/22 |
| 2005/0009724 | A1 * | 1/2005 | Arredondo et al. | 510/421 |
| 2005/0050644 | A1 * | 3/2005 | Severns et al. | 8/115.51 |
| 2005/0050758 | A1 * | 3/2005 | Park et al. | 34/425 |
| 2005/0050764 | A1 * | 3/2005 | Jeong et al. | 34/601 |
| 2005/0120585 | A1 * | 6/2005 | Lee et al. | 34/602 |
| 2005/0132604 | A1 * | 6/2005 | Hong et al. | 34/603 |
| 2005/0153869 | A1 * | 7/2005 | Connor et al. | 510/515 |
| 2005/0183208 | A1 * | 8/2005 | Scheper et al. | 8/142 |
| 2005/0246920 | A1 * | 11/2005 | Yabuuchi et al. | 34/515 |
| 2005/0278972 | A1 * | 12/2005 | Maruca | 34/201 |
| 2006/0137205 | A1 * | 6/2006 | Lee et al. | 34/60 |
| 2006/0137206 | A1 * | 6/2006 | Lee et al. | 34/86 |
| 2006/0201020 | A1 * | 9/2006 | Cimetta et al. | 34/468 |
| 2006/0225468 | A1 * | 10/2006 | Hong | 68/20 |
| 2006/0248746 | A1 * | 11/2006 | Dittmer et al. | 34/534 |
| 2006/0289533 | A1 * | 12/2006 | Park et al. | 219/757 |
| 2006/0293204 | A1 * | 12/2006 | Kaneda et al. | 510/376 |
| 2007/0101602 | A1 * | 5/2007 | Bae et al. | 34/77 |
| 2007/0107250 | A1 * | 5/2007 | Gassmann et al. | 34/82 |
| 2007/0144032 | A1 * | 6/2007 | Maruca | 34/469 |
| 2007/0151041 | A1 * | 7/2007 | McAllister et al. | 8/149.2 |
| 2007/0151119 | A1 * | 7/2007 | Heyder et al. | 34/601 |
| 2007/0151129 | A1 * | 7/2007 | McAllister et al. | 38/3 |
| 2007/0151310 | A1 * | 7/2007 | Wright et al. | 68/3 R |
| 2007/0151311 | A1 * | 7/2007 | McAllister et al. | 68/3 R |
| 2007/0151312 | A1 * | 7/2007 | Bruce et al. | 68/3 R |

2007/0163093 A1* 7/2007 Wright et al. ..... 28/100
2007/0163094 A1* 7/2007 Wright et al. ..... 28/100
2007/0163095 A1* 7/2007 McAllister et al. ..... 28/100
2007/0163096 A1* 7/2007 McAllister et al. ..... 28/100
2007/0163097 A1* 7/2007 Metcalfe et al. ..... 28/100
2007/0163098 A1* 7/2007 Tomasi et al. ..... 28/100
2007/0265183 A1* 11/2007 Meine et al. ..... 512/3
2008/0011123 A1* 1/2008 Correa Pena y Lillo et al. ..... 75/10.3
2008/0092403 A1* 4/2008 Bae et al. ..... 34/487
2008/0110042 A1* 5/2008 Ackermann et al. ..... 34/487
2008/0163510 A1* 7/2008 Dittmar et al. ..... 34/108
2008/0189974 A1* 8/2008 Dittmer et al. ..... 34/132
2008/0200432 A1* 8/2008 Suzuki et al. ..... 514/63
2008/0209645 A1* 9/2008 Carrillo et al. ..... 8/137
2008/0248323 A1* 10/2008 Radomyselski et al. ..... 428/540
2008/0289212 A1* 11/2008 Moon et al. ..... 34/267
2009/0094852 A1* 4/2009 Tatsumi et al. ..... 34/132
2009/0094854 A1* 4/2009 Cimetta et al. ..... 34/562
2009/0126218 A1* 5/2009 Dittmer et al. ..... 34/130
2009/0176681 A1* 7/2009 Kaneda et al. ..... 510/311
2009/0211309 A1* 8/2009 Kawabata et al. ..... 68/20
2010/0005681 A1* 1/2010 Jo et al. ..... 34/215
2010/0011605 A1* 1/2010 Kim et al. ..... 34/60
2010/0011606 A1* 1/2010 Kim et al. ..... 34/60
2010/0011607 A1* 1/2010 Kim et al. ..... 34/60
2010/0011611 A1* 1/2010 Kim et al. ..... 34/390
2010/0011615 A1* 1/2010 Steiner ..... 34/493
2010/0018262 A1* 1/2010 Beihoff et al. ..... 68/5 C
2010/0024243 A1* 2/2010 Ricklefs et al. ..... 34/474
2010/0035791 A1* 2/2010 Igarashi et al. ..... 510/513
2010/0077628 A1* 4/2010 Bae et al. ..... 34/60
2010/0115784 A1* 5/2010 Jo et al. ..... 34/132
2010/0155326 A1* 6/2010 Grunert ..... 210/507
2010/0170776 A1* 7/2010 Ehrenberg et al. ..... 202/168
2010/0186176 A1* 7/2010 Wright et al. ..... 8/137
2011/0016928 A1* 1/2011 Beihoff et al. ..... 68/19
2011/0062145 A1* 3/2011 Yang et al. ..... 219/538

FOREIGN PATENT DOCUMENTS

DE 3219977 A1 * 12/1983
DE 3446468 A1 * 7/1986
DE 3933949 A1 * 4/1991
DE 3943082 A1 * 7/1991
DE 4238546 A1 * 5/1994
DE 4306215 A1 * 9/1994
DE 4306217 A1 * 9/1994
DE 4307372 A1 * 9/1994
DE 4434205 A1 * 3/1996
DE 4444090 A1 * 6/1996
DE 19506919 A1 * 8/1996
DE 19508244 A1 * 9/1996
DE 198 11 962 9/1999
DE 102 02 442 8/2003
DE 103 46 107 6/2005
EP 211418 A2 * 2/1987
EP 356689 A1 * 3/1990
EP 468573 A1 * 1/1992
EP 543166 A1 * 5/1993
EP 548386 A1 * 6/1993
EP 575759 A1 * 12/1993
EP 699795 A1 * 3/1996
EP 740012 A1 * 10/1996
EP 1146161 A1 * 10/2001
GB 2044297 A * 10/1980
GB 2047277 A * 11/1980
GB 2091123 A * 7/1982
GB 2105452 A * 3/1983
GB 2288457 A * 10/1995
WO WO 9207989 A1 * 5/1992
WO WO 00/58545 10/2000

* cited by examiner

CONDENSATION TYPE LAUNDRY DRYER

The invention relates to a condensation washer-dryer with a washer drum that can rotate about at least an almost horizontal axis, with means for driving and guiding the washer drum, with components for delivering and guiding process air and cooling air, with a heating device for the process air, with a condenser for condensing the dampness extracted from the items to be dried and borne in the process air, with devices for drawing off the condensate and with a supporting structure for mounting the main functional parts and stabilizing the device.

BACKGROUND OF THE INVENTION

Condensation washer-dryers are characterized by a process airflow delivered in a closed circuit system. The process air, heated to a predetermined temperature, is blown in through the back of the motor-driven washer drum, where the items to be dried are revolved and treated with the heated process air. The washer drum is filled and emptied with items to be dried via a front loading opening that can be closed by a door hinged to the front wall. The process air enriched by dampness from the items to be dried is passed through a process air duct leading downwards to the condenser, where the heat from the process air is extracted by cool air drawn in from outside and conducted through a second air guidance system, so that the dampness taken from the items to be dried is condensed and finally discharged.

The condenser is a single component housed in a bottom assembly. Mountings for the drive motor, the fan for the cooling and process air, a condensate drip tray and condensate pump, as well as devices for delivering and guiding process air and cooling air are integrated into the bottom assembly.

The cooled and dehumidified process air is returned to the inside of the drum via a heating device. The delivery of the cooling and process air is by means of fans that are usually coupled with the drive motor of the washer drum.

A condensation washer dryer of this kind, which is typical in its design, is described in DE 102 02 442 A1. The process air duct section assigned to the process air inlet and aligned toward the rear wall of the device has a vertical connecting surface to the heating duct. Additional sealant is provided to adequately seal the process airflow at the connecting surface.

The bottom assembly and the mountings within it for the condenser and the housings for the cooling and process air fans cannot be manufactured as a single piece using injection molding. This assembly has to be manufactured in several single components and joined together to form a unit. In order to achieve adequate sealing, additional sealant is provided at these joints, particularly on the ducts provided to guide the process air.

With known washer-dryers, the heating duct is permanently connected to the rear wall of the device and is mounted on the base assembly complete with the rear wall of the device. The connection is secured by the rear wall being bolted against a frame of the washer dryer. Similar design solutions are also found with other standard washer-dryers.

SUMMARY OF THE INVENTION

The object of the invention is to provide a design for the supporting structure of a condensation washer-dryer as described in the introduction, which represents the technically most efficient solution compared to the prior art with respect to securing the necessary functions, especially with regard to the sealing of the processed air guidance, and takes account of aspects of mechanical stability, production and assembly technology and economy.

The object of the invention is achieved by the features of the exemplary embodiments described herein, in that the supporting structure is formed from a bottom base module and a process air cover that is permanently joined, without using a seal, to the back of the base module.

According to the invention, the base module that serves for mounting functional parts and components of the air guidance is closed at the back by a process air cover. For this purpose, the base module has a vertical separating surface. The separating surface has a large area and preferably extends over the complete width of the washer-dryer. The main advantage of this solution is that by means of a single component, the process air cover, an air guidance component with ducts is formed on the back of the base module, which on one hand connects the condenser housing with the process air fan and on the other hand connects the process air fan with the heating duct. Furthermore, the process air cover represents a closure for the condenser housing and for the housing of the process air fan on the base module.

The base module and process air cover are plastic components that in the embodiment of the invention are welded together. No sealing element is required for a joint of this kind. It is also advantageous that an extraordinarily high mechanical rigidity is obtained by the base module expanded to a supporting structure connected to the welded process air cover.

Compared with known solutions, substantial advantages can be achieved by the inventive supporting structure on the basis of the base module with regard to the sealing of the process air guidance, with regard to the mechanical strength of the base module as a single unit and as part of the complete supporting structure, as well as with regard to an effective production of the individual components and of their assembly.

Further advantageous embodiments of the invention are described herein, which can be used either individually or in any combination with each other without departing from the concept of the invention.

BRIEF DESCRIPTION OF THE DRAWINGS

The invention is explained in more detail in the following with the aid of the exemplary embodiment shown in the drawings. The drawings are as follows.

DETAILED DESCRIPTION OF THE EXEMPLARY EMBODIMENTS OF THE PRESENT INVENTION

Figure 1:
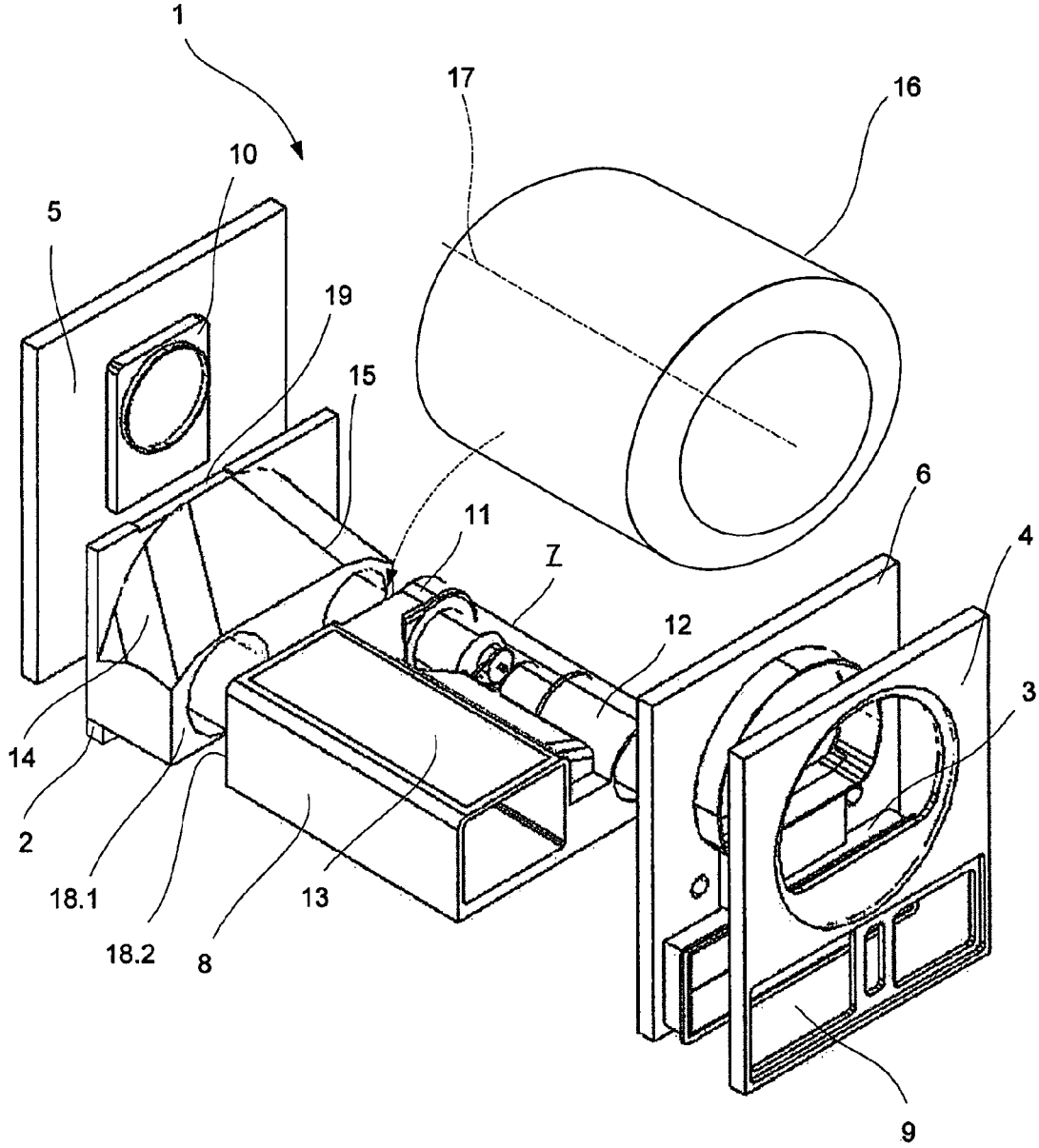
FIG. 1A perspective exploded view of a condensation washer-dryer

The elements important for the functioning of the inventive supporting structure of a condensation washer-dryer 1 are illustrated. In the illustrated preferred embodiment, the front wall 4 and the bearing bracket 6, matched in size and shape to the front wall 4, form a stable combined body. The front of the combined body 4, 6 and the rear wall 5 carrying the heating device, concealed under the heating duct 10, are joined together by the base module 7. For this purpose, the combined body 4, 6 is attached by a plug-in and bolted joint to the base module 7, whereas the rear wall 5 is bolted to the process air cover 14.

The washer drum 16 mounted so as to rotate about the axis 17 is fitted between a bearing flange on the back of the bearing bracket 6 and a sealing ring fitted on the heating duct 10. It is seated with its front opening on the bearing flange (not visible) and a rear opening (also not visible) on the outlet opening of the heating duct 10. From the heating duct 10, hot air is blown into the washer drum 16 and discharged downwards by it through the loading opening of the front wall 4, surrounded by the front bearing flange, and out through the fluff filter 3.

Figure 2:
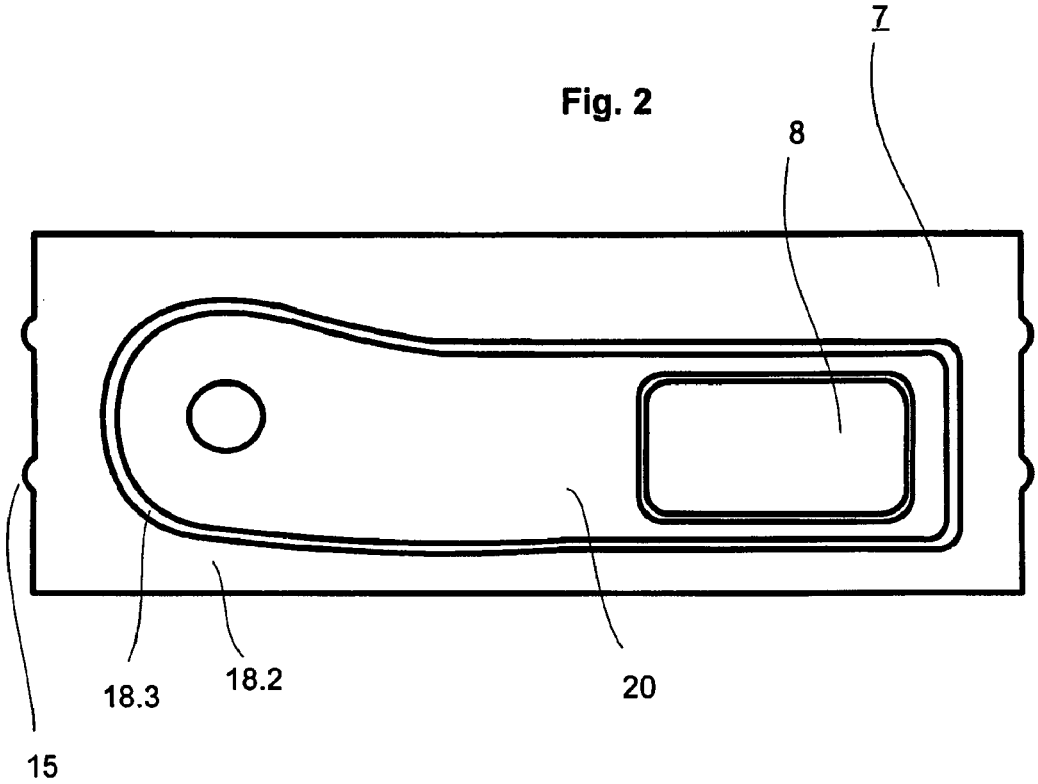
FIG. 2 A view of the base module from behind

The base module 7 is a compact plastic unit manufactured using injection molding, that due to its shape and its additional molded ribs 15 (FIGS. 2 and 3) in the bottom and/or side area is largely resistant to bending and torsion. The basic module 7 houses a condensate drip tray, the air guidance and conducting devices and the condenser 8, a condensate delivery pump, the drive motor and the process air and cooling air fans 11 and 12. Suitable moldings are provided in the plastic body of the base module 7 for this purpose. The condenser housing 8 can be closed from above by a cover 13 snapped into place; a second cover is, as part of its housing, is snapped into place on the cooling air fan 12.

The base module 7 takes up almost all the complete internal width of the washer-dryer 1 and is closed off over the complete back by the process air cover 14, which is welded to the base module 7. For this purpose, the flat connecting surfaces 18.1 and 18.2 of the process air cover 14 and of the base module 7 are to be placed tight against each other and joined together, for example, by hot tool or vibration welding.

The single-piece process air cover 14 together with the base module 7 form a rear process air duct component 20 that connects the condensate housing 8 with the inlet opening 22 of the process air fan 11. A second process air duct component 21 connects the pressure side of the fan 11, via its transfer opening 19, to the heating duct 10. Therefore, to form the process air guidance only two single components are used, i.e. the base module 7 and the process air cover 14. By welding both plastic components 7, 14 along a weld joint 18.3 running directly around the process air duct component 20, there is no longer a need for the, otherwise usual, sealant because the welded joint surfaces 18.1 and 18.2 surround, and when joined seal, all air-carrying components. Furthermore, additional means for securing the joint, such as bolting, are dispensed with.

The process air cover 14 is not supported anywhere; it is welded to the base module 7 and is therefore itself part of the supporting structure of the washer-dryer 1.

Due to the welded joint 18.3 and the size of the connecting surfaces 18.1 and 18.2, the supplemented base module 7 has such a high strength that it can completely replace a framework housing in the bottom area, which is used by the majority of known washer-dryers. The resistance to torsion of the basic module 7 is reinforced by the shape of the rigidly-connected process air cover 14 and by additional integrally-formed stiffening ribs 15.

Figure 3:
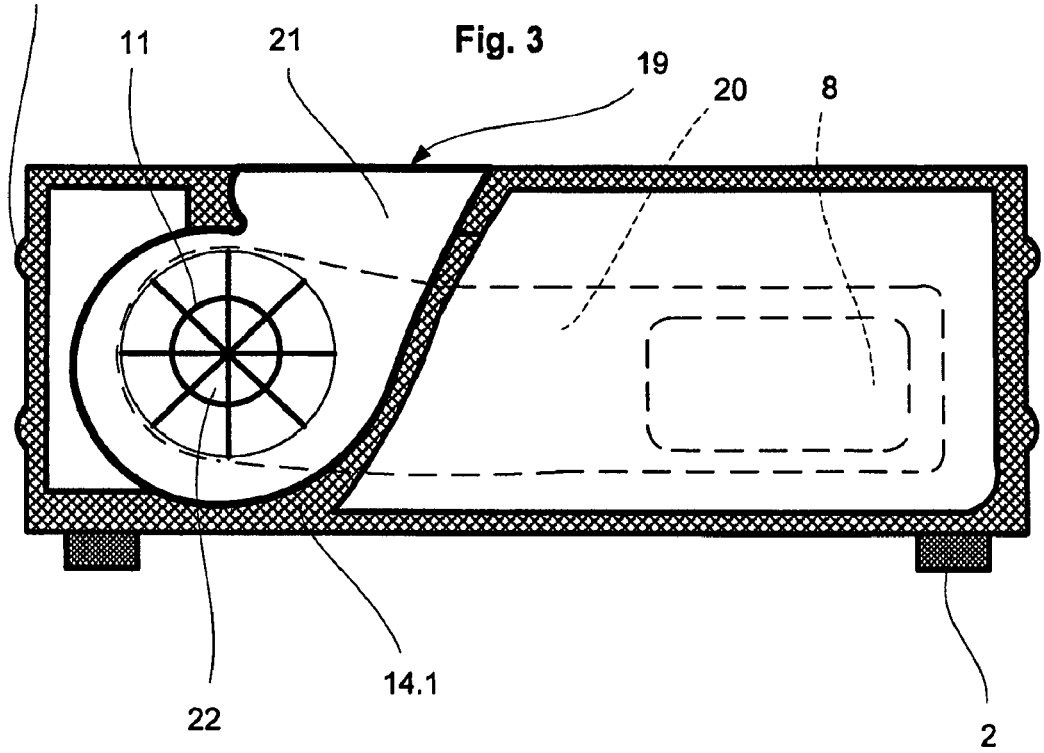
FIG. 3 A view, also from behind, of the process air cover

The rearward separating surface 14.1 of the process air cover 14, shown hatched in FIG. 3, is designed as the bearing surface for the rear wall 5 of the device. This is bolted to the process air cover 14 over a large area. The remaining surfaces, except the inlet opening 22 of the fan housing (see 11), form a rearward closure of the base module 7 by which means the housing of the condenser 8 and the process air duct component 20 in particular are closed.

In the illustrated preferred exemplary embodiment, the rear feet 2 for the washer-dryer 1 are integrally formed as part of the process air cover 14, thus achieving a further rationalization effect. Correspondingly, feet can also be fitted at the front end of the base module 7.

LIST OF REFERENCE CHARACTERS

1 Washer-dryer
2 Feet
3 Fluff screen
4 Front wall
5 Rear wall
6 Bearing bracket
7 Base module
8 Condenser housing
9 Slide-in opening for condenser
10 Heating duct
11 Process air fan
12 Cooling air fan
13 Condenser housing cover
14 Process air cover
14.1 Separating surface
15 Stiffening ribs
16 Washer drum
17 Axis of rotation
18.1 Base module connecting surface
18.2 Process air cover connecting surface
18.3 Welded joint
19 Transition opening
20 Process air duct part, condenser-fan
21 Process air duct part, fan-heating duct
22 Inlet opening

The invention claimed is:

1. A condensation laundry dryer comprising:

a laundry drum that can be rotated about a substantially horizontal axis, with means for drying and for guiding the laundry drum;

main functional components for delivering and guiding process air and cooling air, with a heating device for the process air;

a condenser for condensing dampness drawn from items to be dried and borne in the process air;

devices for discharging condensate; and a supporting structure for mounting the main functional components and stabilizing the laundry dryer, said supporting structure being formed from a bottom base module and a process air cover that is permanently connected to a rear of the bottom base module and joined without using a seal; and wherein the process air cover and the bottom base module together form an air guidance duct component that connects the condenser to a process air fan.

2. The laundry dryer as claimed in claim 1, further comprising a connecting surface that essentially lies in a vertical plane or in at least two vertical planes offset relative to each other in two steps is provided between the bottom base module and the process air cover and encloses the air transfer between the bottom base module and the process air cover.

3. The laundry dryer as claimed in claim 2, wherein the connecting surface extends at least approximately over a complete width of the laundry dryer.

4. The laundry dryer as claimed in claim 1, wherein the bottom base module and process air cover are plastic components.

5. The laundry dryer as claimed in claim 4, wherein the process air cover and the bottom base module are welded to each other.

6. The laundry dryer according to claim 1, wherein the connecting surface is fitted to a front wall of the process air cover that forms a rear closure of the condenser housing and a fan housing of the process air fan, and is welded to the connecting surface on the bottom base module.

7. The laundry dryer as claimed in claim 1, wherein stiffeners and/or ribs are integrally formed on the bottom base module and/or on the process air cover.

8. The laundry dryer as claimed in claim 1, wherein feet are integrally formed on the bottom base module and/or on the process air cover.

9. The laundry dryer as claimed in claim 1, wherein a back of the process air cover is permanently connected by a separating surface with a rear wall of the laundry dryer.

10. The laundry dryer as claimed in claim 9, wherein a fan housing for the process air fan is incorporated into the process air cover, a pressure side of said process air fan being connected via a process air duct component, also incorporated, to a transition opening as a connection to a heating duct.

11. The laundry dryer as claimed in claim 9, wherein the process air cover is bolted to the rear wall.

12. The laundry dryer of claim 1, wherein the bottom base module includes one of stiffeners and ribs.

13. The laundry dryer of claim 1, wherein the process air cover includes one of stiffeners and ribs.

14. The laundry dryer of claim 1, comprising:

front feet integrally formed on a bottom surface of the bottom base module.

15. The laundry dryer of claim 1, comprising:

rear feet integrally formed on a bottom surface of the process air cover.

16. A condensation laundry dryer comprising:

a body including a front wall and a rear wall;

a laundry drum disposed between the front wall and rear wall, the laundry drum being rotatable about a substantially horizontal axis;

a supporting structure coupling the front wall to the rear wall, the supporting structure for mounting main functional components of the laundry dryer and stabilizing the front wall with respect to the rear wall;

the supporting structure being formed by a bottom base module coupled to the front wall and a process air cover coupled to the rear wall, wherein the process air cover is permanently connected to a rear of the bottom base module and joined without using a seal, wherein the bottom base module includes:

a process air fan and a cooling air fan for delivering process air and cooling air to the laundry drum;

a condenser for condensing dampness drawn from items to be dried in the laundry drum and borne in the process air; and a device for discharging condensate, wherein the process air cover and the bottom base module together form an air guidance duct component that connects the condenser to the process air fan.

17. The condensation laundry dryer of claim 16, wherein the front wall includes a bearing bracket, and wherein the bottom base module is coupled to the bearing bracket.

18. The laundry dryer of claim 16, wherein the bottom base module includes one of stiffeners and ribs.

19. The laundry dryer of claim 16, wherein the process air cover includes one of stiffeners and ribs.

20. The laundry dryer of claim 16, comprising:

front feet integrally formed on a bottom surface of the bottom base module.

21. The laundry dryer of claim 16, comprising:

rear feet integrally formed on a bottom surface of the process air cover.

* * * * *

UNITED STATES PATENT AND TRADEMARK OFFICE

CERTIFICATE OF CORRECTION

PATENT NO. : 7,984,568 B2
APPLICATION NO. : 11/920014
DATED : July 26, 2011
INVENTOR(S) : Lothar Dittmer et al.

It is certified that error appears in the above-identified patent and that said Letters Patent is hereby corrected as shown below:

Title page, item (22) should read as follows: PCT Filed: Feb. 1, 2006

Signed and Sealed this
Twenty-third Day of August, 2011

David J. Kappos

David J. Kappos
*Director of the United States Patent and Trademark Office*